United States Patent [19]

Castle

[11] Patent Number: 4,765,381

[45] Date of Patent: Aug. 23, 1988

[54] SIGN CARRIER AND STORAGE BAG

[76] Inventor: Michael C. Castle, 7565 Manresa Ct., San Jose, Calif. 95139

[21] Appl. No.: 118,282

[22] Filed: Nov. 6, 1987

[51] Int. Cl.[4] ..... B65D 33/00; B65D 33/16

[52] U.S. Cl. ..... 150/52 R; 383/32; 383/67; 383/95; 383/97

[58] Field of Search ..... 383/32, 67, 97, 95; 150/52 R, 52 G

[56] References Cited

U.S. PATENT DOCUMENTS

| | | | |
|---|---|---|---|
| 931,853 | 8/1909 | Forehand | 383/86 X |
| 2,602,482 | 7/1952 | Lyon | 383/95 X |
| 3,172,444 | 3/1965 | Frommelt et al. | 383/67 X |
| 3,275,053 | 9/1966 | Kabana | 150/42 |
| 3,426,815 | 2/1969 | Ashlin et al. | 150/52 G |
| 3,642,679 | 2/1972 | Young | 260/23.3 |
| 4,079,767 | 3/1978 | Howard | 150/3 |
| 4,249,687 | 2/1981 | Warnier | 224/913 |
| 4,531,178 | 7/1985 | Rauscher | 43/26 |

*Primary Examiner*—William Price
*Attorney, Agent, or Firm*—Thomas Schneck

[57] ABSTRACT

A sign storage and carrying apparatus having first and second cover panels and having first and second side walls fixed to the opposed lateral edges of the cover panels to retain the cover panels in a parallel, substantially coextensive condition. An upper wall is connected to the top edges of the cover panels to form a protective pocket having a base opening. Fastening members are fixed to the opposed interior surfaces of said first and second cover panels for recurringly sealing selected portions of the base opening. Preferably, one fastening member is a hook fastening strip and the opposite fastening member is a loop fastening strip. A handle is mounted to the upper wall to facilitate carrying of the apparatus, while stacking strips are fixed to the exterior surfaces of the cover panels to permit stacking.

18 Claims, 2 Drawing Sheets

SIGN CARRIER AND STORAGE BAG

DESCRIPTION

TECHNICAL FIELD

The invention relates to apparatus used for storing and carrying of large signs and similar flat articles.

BACKGROUND ART

In the marketing of homes, a real estate sales firm will have various signs printed to announce both the availability of houses and the office or person that may be contacted for any inquiries. Individual real estate agents will also purchase signs.

Real estate signs may be a simple "For Sale" sign or may mark some other occasion, such as an open house. Typically, such signs are wood or plastic measuring a few feet in each dimension and have downwardly depending support legs or stakes which are forced into the ground or spread apart and set on the ground. Transportation of real estate signs is cumbersome and carries the risk of damaging the signs. Real estate signs are not inexpensive. But the dimensions of the signs require that when they are transported in a passenger car of a real estate agent, then the signs must be stored in the trunk of the vehicle, rather than on a rear seat. Storage in side-by-side relation results in scratching of the signs, especially if the support stake of one sign is brought into contact with the face of another sign. Even when stored alone, an unprotected real estate sign will deteriorate prematurely.

While it is possible to wrap each real estate sign individually, a cloth covering does not insure that the signs will remain covered. It is an object of the present invention to provide an apparatus which protects individual real estate signs in side-by-side relation during transportation between sites, and which prevents inadvertent removal from the apparatus.

DISCLOSURE OF THE INVENTION

The above object has been met by a sign storage and carrying bag which encases the face of a real estate sign in a protective envelope, but which allows a support stake or support legs of the sign to extend out of the protective envelope. The protective envelope includes first and second rectangular cover panels which are joined at opposed side by side walls and joined at an upper end by an upper wall. The cover panels, the side walls and the upper wall combine to form a pocket having a base opening sufficiently wide to permit insertion of a sign.

The interior surface of the cover panels have the opposed members of a closure means which provides recurring sealing of selected portions of the base opening. Preferably, the closure means comprises opposed Velcro strips. (Velcro is a trademark for synthetic materials, formed in strips, which adhere when pressed together.) In use, the face of a sign is inserted through the base opening and then the base opening is sealed around the sign's support members. The Velcro strips permit a snug fit about the support stake to prevent entry of large dirt particles into the sign pocket. When the support members are not of the type which is inserted into the ground at various sites, it is not as important that the closure means provide a snug fit about the support legs. Thus, it is foreseeable to replace the Velcro strips with opposed zipper members or snap members on the interior surfaces of the cover panels.

Velcro strips are also utilized on the exterior surfaces of the cover panels. A hook fastening strip is attached to one cover panel, while a loop fastening strip is attached to the other cover panel. Thus, a number of real estate signs may be stacked by mating the hook fastening strip from one sign storage apparatus with the loop fastening strip of an adjacent sign storage apparatus. In this manner, any number of signs may be stacked in an orderly and protected fashion.

A handle is mounted to the upper wall of the apparatus so that an enclosed real estate sign may be carried more easily. Moreover, the downward extension of the side walls are less than that of the cover panels so that the cover panels may be peeled back somewhat at the base opening, thereby facilitating insertion of a sign.

An advantage of the present invention is that real estate signs may be stored in a protective pocket to prevent premature deterioration. Another advantage is that the side walls and top walls that link opposed cover panels promote easy insertion and a snug fit. A third advantage is that the present invention may be recurringly sealed along selected portions of the base opening, thereby insuring that the lower edge of the sign is securely retained within the protective pocket even though the support stake or support legs are permitted to extend from the protective envelope.

BEST MODE FOR CARRYING OUT THE INVENTION

Figure 1:
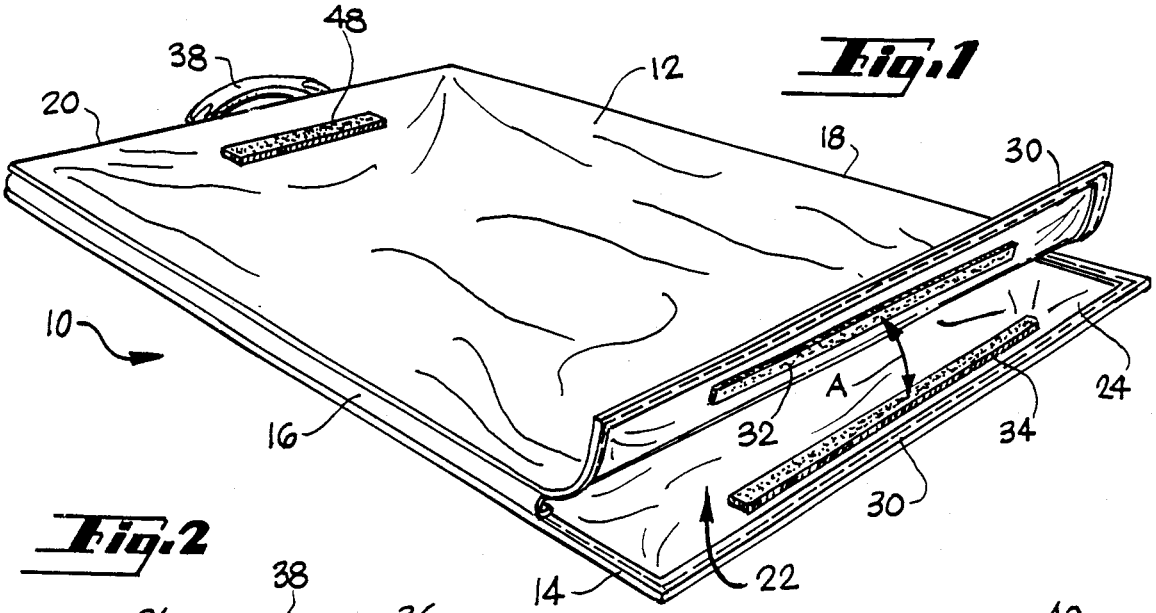
FIG. 1 is a perspective view of a sign storage and carrier bag in accord with the present invention.
Figure 2:
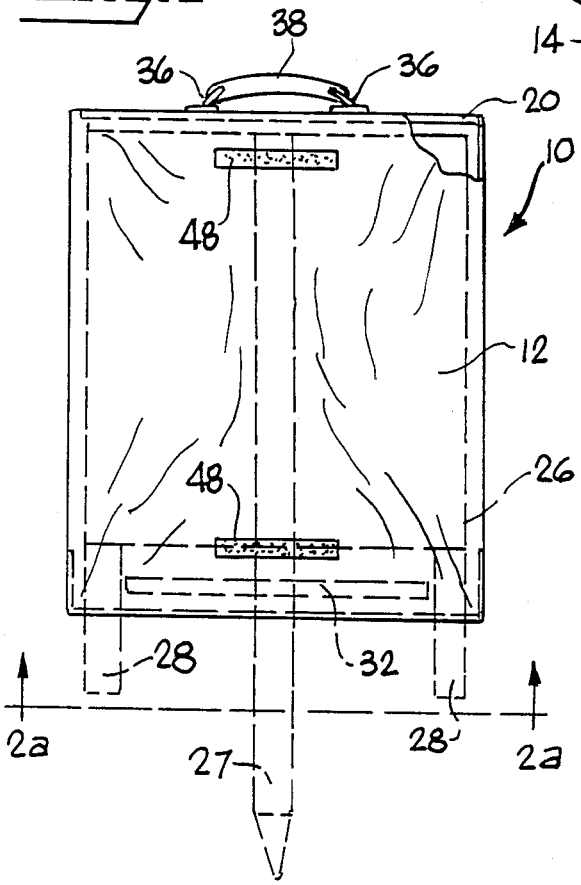
FIGS. 2 and 3 are front views of the apparatus of FIG. 1.
Figure 2A:
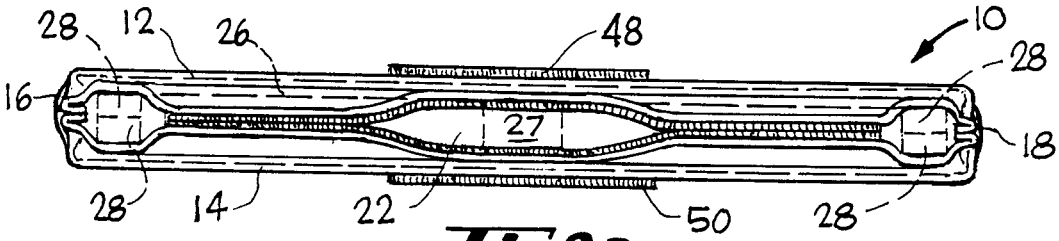
FIG. 2*a* is a bottom view of the apparatus of FIG. 2, taken along lines 2*a*–2*a*.

With reference to FIGS. 1–2*a*, a sign storage and carrier apparatus 10 includes a front and a rear cover panel 12 and 14. The cover panels are connected at opposite sides by side walls 16 and 18 and connected at the top by an upper wall 20. The cover panels 12 and 14 and the side walls 16 and 18 are made of a flexible material, such as canvas or vinyl. Typically, the cover panels are approximately 24.5 inches across the upper wall 20 and have a longitudinal dimension of approximately 34.5 inches. The side walls 16 and 18 are connected to permit a cover panel separation of approximately three inches.

The cover panels 12 and 14 and the walls 16–20 combine to form a protective pocket 22 having a base opening 24. FIGS. 2 and 2*a* illustrate a sign 26 inserted into the protective pocket, with a downwardly depending support legs 28 projecting from the sign storage apparatus 10. The sign 26 is an A-frame assembly having opposed pairs of legs 28. The sign is hinged so that as the pairs of legs are separated an A-frame is formed. Alternatively, the sign 26 may have a stake 27 for insertion into soil. The side walls 16 and 18 have a longitudinal extension that is less than the longitudinal extension of the cover panels 12 and 14 to provide a notch at the base opening 24 of the protective pocket 22. Thus, the cover panels 12 and 14 may be folded to a spaced apart position, as shown by Arrow A in FIG. 1. The notch at the base opening 24 facilitates insertion of a sign 26 into the protective pocket 22. The outermost edge of each cover panel 12 and 14 is doubled over and held in position by stitching 30 to reduce the possibility of fraying.

A first fastening strip 32 is mounted to the interior surface of the front cover panel 12, while a second fastening strip 34 is mounted to the back cover panel 14. The mating strips 32 and 34 are aligned to make frictional contact when the cover panels are brought together. The fastening strips 32 and 34 are Velcro-type strips. The first strip 32 is a hook fastening strip and the second strip 34 is a loop fastening strip. When forced together, a plurality of hooks on the first strip 32 attach to loops on the second strip 34 to secure a sign 26 within the protective pocket 22. The hook and the loop fastening strips permit recurring sealing of selected portions of the base opening 24. Thus, as shown in FIG. 2*a*, the protective pocket 22 may be sealed at the base opening, but the support legs 28 may still protect from the pocket. In this manner, the sign 26 is better protected from soil entering the protective pocket 22 through the spacing about the support stake 28. Typically, the fastening strips 32 and 34 are approximately one and one-half inches wide.

Figure 3:
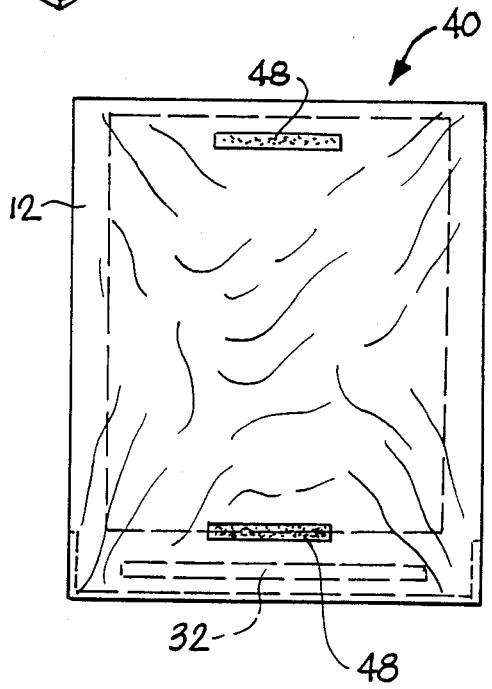

A pair of spaced apart lugs 36 are connected to the upper wall 20, and a handle 38 bridges the lugs 36. The handle 38 facilitates moving of the sign storage apparatus 10. The handle 38, however, is not a critical feature. FIG. 3 illustrates a sign storage apparatus 40 which does not include a handle. The apparatus 40 of FIG. 3 is identical to that of FIGS. 1–2*a* other than the absence of the handle and a wood frame at the upper wall for securement of the handle. The sign storage apparatus 40 includes the cover panels 12 and 14 as well as the side walls, not shown, and the mating strips 32 and 34.

Figure 4:
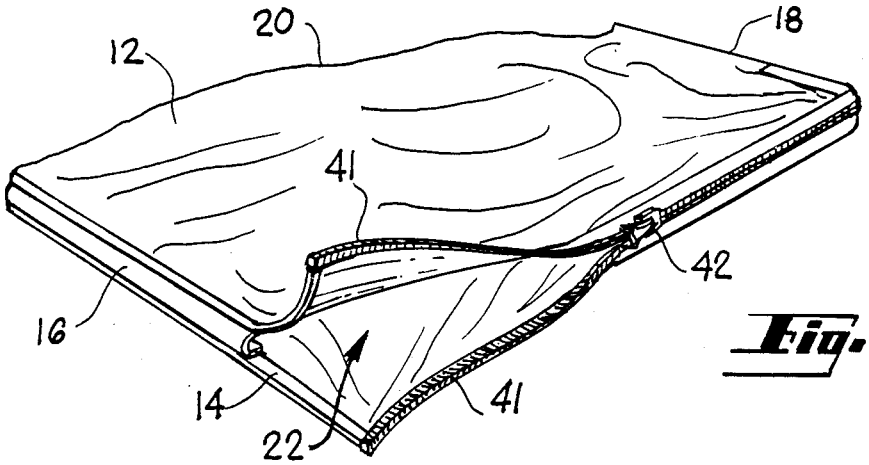
FIG. 4 is a perspective view of a second embodiment of the apparatus of FIG. 1.

In the embodiment of FIG. 4 the fastening strips have been replaced by a zipper having two rows 41 of interlocking tabs which are selectively joined by a connecting member 42. The joining of the rows 41 of tabs seals a protective pocket 22 formed by cover panels 12 and 14, side walls 16 and 18 and the upper wall 20. A single connecting member 42 is shown in FIG. 4. The rows 41 of tabs, however, are preferably joined by either of two oppositely facing connecting members. The inclusion of a second connecting member permits sealing of the protective pocket 22 from both sides of a sign's support legs.

Figure 5:
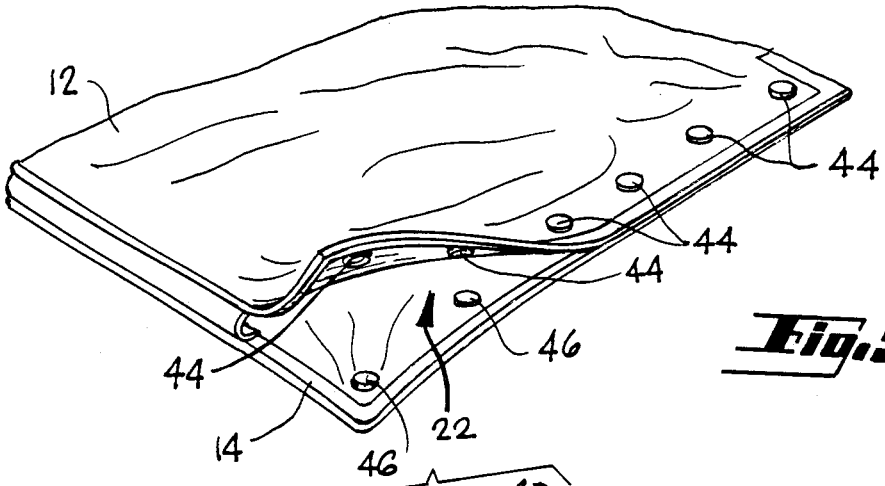
FIG. 5 is a perspective view of a third embodiment of the apparatus of FIG. 1.

FIG. 5 shows a third embodiment in which a protective pocket 22 is closed by a row of snaps, each snap having a clasp member 44 and an insert member 46. The clasp members 44 are each attached to the front cover panel 12 and aligned to grasp an insert member 46, thereby closing the protective pocket 22. The snaps are best suited for storage of signs which are less likely to be soiled, such as signs having support legs that are to be held vertically by a means other than by being forced into soil. The Velcro strips of FIGS. 1–2*a* are more reliable than the snaps in preventing entrance of foreign matter into the protective pocket.

Figure 6:
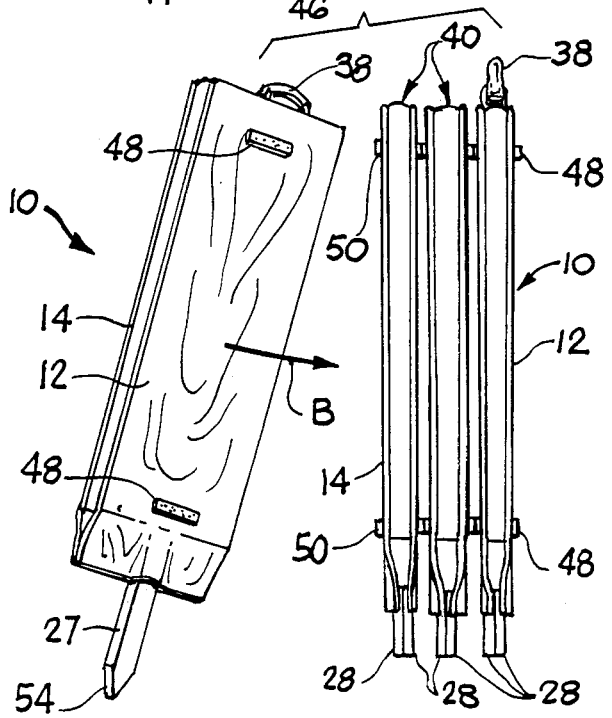
FIG. 6 is a perspective view of a plurality of the apparatus of FIG. 1, shown in a stacked fashion.

Returning to FIGS. 1–2*a*, the sign storage and carrier apparatus 10 includes a second set of Velcro strips. A pair of front stacking strips 48 are fixed to the front cover panel 12 and a pair of rear stacking strips 50 are attached to the rear cover panel 14. The front stacking strips 48 are typically hook fastening strips, while the rear strips 50 are loop fastening strips. Thus, a plurality of signs may be stacked by connecting the strips 48 of a front cover panel 12 with the strips 50 of a rear cover panel 14, as shown by Arrow B in FIG. 6.

In operation, a cover panel 12 and 14 is folded back as indicated by Arrow A in FIG. 1 to accept a sign into the protective pocket 22. The present invention has been explained with reference to real estate signs having support legs 28. However, the present invention is not limited to support legs having the configuration illustrated in the drawings. The term "leg" is understood to include any type of sign support member. For example, in FIG. 6 a support stake 27 is shown in addition to the support legs 28. The support stake 27 is an elongated member having a tapering extremity 54 for insertion into soil. The Velcro strips 32 and 34 permit closure of the protective pocket 22 about the support stake 27, as shown in FIG. 2*a*.

After insertion of the sign into the protective pocket 22, the fastening strips 32 and 34 are brought together to secure the sign. The handle 38 may be used to carry the sign storage apparatus in those instances in which a plurality of signs are transported. Moreover, front and rear stacking strips 48 and 50 permit orderly stacking in side-by-side relation.

I claim:

1. An apparatus for storing and carrying signs of the type having a mounting post, comprising, first and second cover panels, each having top and base edges and having opposed lateral edges, first and second spaced apart side walls, each side wall fixed to one of said opposed lateral edges of each cover panel to retain said first and second cover panels in a parallel, substantially coextensive condition, an upper wall fixed to said top edges of said cover panels, said cover panels and said upper and side walls combining to form a pocket having a base opening, closure means for recurringly sealing selected portions of said base opening, said closure means having at least one first fastening member attached to an interior surface of the first cover panel and having at least one second fastening member attached to an interior surface of the second cover panel, and stacking means attached to exterior surfaces of said cover panels for selective attachment to similarly constructed cover panels.

2. The apparatus of claim 1 further comprising a handle fixedly attached to said upper wall.

3. The apparatus of claim 1 wherein said first fastening member of the closure means is a hook fastening strip and second fastening member is a loop fastening strip, each of said strips extending substantially parallel to said base opening.

4. The apparatus of claim 1 wherein said stacking means includes at least one hook fastening strip fixed to the exterior surface of said first cover panel and includes at least one loop fastening strip fixed to the exterior surface of said second cover panel.

5. The apparatus of claim 1 wherein each side wall has a downward extension, relative to said upper wall, that is less than the downward extension of said cover panels.

6. The apparatus of claim 1 wherein said closure means is a plurality of snaps, each having a first insert member and a second clasp member.

7. The apparatus of claim 1 wherein said closure means is at least one zipper.

8. An apparatus for storing and carrying flat rectangular signs of the type having a mounting post, comprising, parallel and substantially coextensive first and second cover panels, said cover panels having facing interior surfaces and having external surfaces, said cover panels each having a top and a base edge, a plurality of walls connecting said cover panels to form a pocket, said pocket having a pocket opening at the base edges of said cover panels, closure means for selectively sealing elected portions of said pocket opening, said closure means including at least one first fastening member and at least one second fastening member, said fastening members fixed to opposed interior surfaces of the cover panels in meshing alignment, handle means positioned at least closely adjacent said top edges of the cover panels for supporting said cover panels and said walls, and stacking means attached to the exterior surfaces of said cover panels for selective attachment to similarly constructed cover panels.

9. The apparatus of claim 8 wherein said first fastening member of the closure means is a hook fastening strip and said second fastening member is a loop fastening strip, each of said strips extending substantially parallel to said pocket opening.

10. The apparatus of claim 8 wherein said stacking means includes at least one hook fastening strip fixed to the exterior surface of said first cover panel and includes at least one loop fastening strip fixed to the exterior surface of said second cover panel.

11. The apparatus of claim 8 wherein said closure means is a plurality of snaps, each having a first insert member and second clasp member.

12. The apparatus of claim 8 wherein said closure means is at least one zipper.

13. A sign storage and carrying apparatus comprising, first and second rectangular cover panels in side-by-side relation, each cover panel having a top and a base edge and having opposed lateral edges, said top and lateral edges of the first cover panel attached in sealing relation to the top and lateral edges of the second cover panel to define a pocket having a base opening, said cover panels each having an exterior surface and an interior surface and being made of a flexible material, closure means for recurringly sealing selected portions of said base opening, said closure means having a first member fixed to said interior surface of the first cover panel and having a second member fixed to the interior surface of the second cover panel in alignment for meshing engagement with said first member, and stacking means attached to the exterior surfaces of the cover panels for selective attachment to similarly constructed cover panels, said stacking means having at least one hook fastening strip fixed to said first cover member and having at least one loop fastening strip fixed to said second cover member.

14. The apparatus of claim 13 further comprising a plurality of walls connecting said cover panels at said top edges and at said opposed lateral edges.

15. The apparatus of claim 13 wherein said first member of the closure means is a hook fastening member and said second member is a loop fastening member, each of said strips extending substantially parallel to said base opening.

16. The apparatus of claim 13 wherein said closure means is a plurality of snaps, each having a first insert member and a second clasp member.

17. The apparatus of claim 13 wherein said closure means is at least one zipper.

18. The apparatus of claim 13 further comprising a handle means positioned at the top of said cover panels for supporting said cover panels.

* * * * *